US010263335B2

(12) United States Patent
Zhou et al.

(10) Patent No.: US 10,263,335 B2
(45) Date of Patent: Apr. 16, 2019

(54) ELECTRONIC DEVICE ANTENNAS HAVING SHARED STRUCTURES FOR NEAR-FIELD COMMUNICATIONS AND NON-NEAR FIELD COMMUNICATIONS

(71) Applicant: Apple Inc., Cupertino, CA (US)

(72) Inventors: Yijun Zhou, Mountain View, CA (US); Yiren Wang, Santa Clara, CA (US); Jennifer M. Edwards, San Francisco, CA (US); Hao Xu, Cupertino, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 65 days.

(21) Appl. No.: 15/700,565

(22) Filed: Sep. 11, 2017

(65) Prior Publication Data

US 2019/0081398 A1 Mar. 14, 2019

(51) Int. Cl.
*H01Q 9/04* (2006.01)
*H01Q 5/328* (2015.01)
*H01Q 1/24* (2006.01)

(52) U.S. Cl.
CPC ..... *H01Q 5/328* (2015.01); *H01Q 9/0421* (2013.01); *H01Q 1/241* (2013.01)

(58) Field of Classification Search
CPC ..... H01Q 5/32; H01Q 9/04; H01Q 1/24
USPC ..... 343/722
See application file for complete search history.

(56) References Cited

U.S. PATENT DOCUMENTS

| | | | | |
|---|---|---|---|---|
| 8,344,959 | B2 | 1/2013 | Autti et al. | |
| 9,537,983 | B2 | 1/2017 | Lee et al. | |
| 2014/0139380 | A1 | 5/2014 | Ouyang et al. | |
| 2015/0303568 | A1* | 10/2015 | Yarga | H01Q 5/321 343/720 |
| 2016/0197401 | A1* | 7/2016 | Ouyang | H01Q 21/30 343/724 |

* cited by examiner

*Primary Examiner* — Andrea Lindgren Baltzell
(74) *Attorney, Agent, or Firm* — Treyz Law Group, P.C.; Joseph F. Guihan

(57) ABSTRACT

An electronic device may be provided with wireless circuitry. The wireless circuitry may include antenna structures such as an antenna resonating element arm and an antenna ground. A split return path may be coupled between the antenna resonating element arm and the antenna ground. The antenna structures may form one or more inverted-F antennas when operated at non-near-field communications frequencies. The antenna structures may be coupled to near-field communications transceiver circuitry using a conductive path. When operated at near-field communications frequencies, near-field communications signals may be conveyed using the conductive path, the antenna resonating element arm, the return path, and the antenna ground. A capacitor may be coupled between the conductive path and an antenna ground. The capacitor may short non-near-field communications signals to the antenna ground and block near-field communications signals from passing from the conductive path to the antenna ground.

20 Claims, 7 Drawing Sheets

ELECTRONIC DEVICE ANTENNAS HAVING SHARED STRUCTURES FOR NEAR-FIELD COMMUNICATIONS AND NON-NEAR FIELD COMMUNICATIONS

BACKGROUND

This relates to electronic devices, and more particularly, to antennas for electronic devices with wireless communications circuitry.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry such as near-field communications circuitry. Near-field communications schemes involve electromagnetically coupled communications over short distances, typically 20 cm or less.

To satisfy consumer demand for small form factor wireless devices, manufacturers are continually striving to implement wireless communications circuitry such as antenna components using compact structures. At the same time, there is a desire for wireless devices to cover a growing number of communications bands. For example, it may be desirable for a wireless device to cover a near-field communications band while simultaneously covering additional non-near-field (far-field) bands such cellular telephone bands, wireless local area network bands, and satellite navigation system bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device may be provided with wireless circuitry. The wireless circuitry may include antenna structures.

The antenna structures may be coupled to non-near-field communications circuitry such as cellular telephone transceiver circuitry. When operated at non-near-field communication frequencies, the antenna structures may be configured to serve as one or more non-near-field antennas. As an example, the antenna structures may be configured to form one or more inverted-F antennas when operated at non-near-field communications frequencies such as frequencies above 600 MHz. The antenna structures may include an antenna resonating element arm that resonates at non-near-field communications frequencies and an antenna ground. A split return path may be coupled between the antenna resonating element arm and the antenna ground.

The antenna structures may also be coupled to near-field communications circuitry such as near-field communications transceiver circuitry using a conductive path. When operated at near-field communications frequencies, near-field communications signals may be conveyed using the conductive path, at least a portion of the antenna resonating element arm, at least a portion of the return path, and at least a portion of the antenna ground.

A capacitor may be coupled between the conductive path and an antenna ground. The capacitor may short non-near-field communications signals to the antenna ground and block near-field communications signals from passing from the conductive path to the antenna ground.

DETAILED DESCRIPTION

Figure 1:
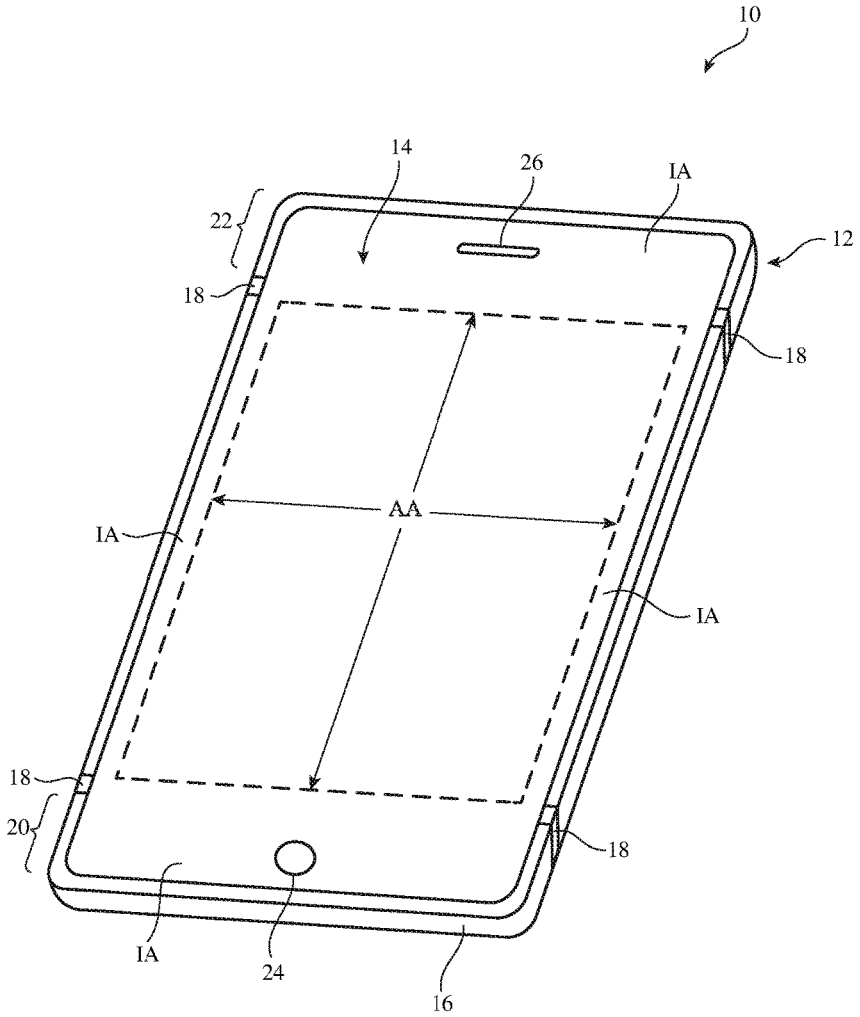
FIG. 1 is a perspective view of an illustrative electronic device in accordance with an embodiment.

Electronic devices such as electronic device 10 of FIG. 1 may be provided with wireless communications circuitry. The wireless communications circuitry may be used to support wireless communications in multiple wireless communications bands.

The wireless communications circuitry may include antenna structures. The antenna structures may include antennas for cellular telephone communications and/or other far-field (non-near-field) communications. Circuitry in the antenna structures may allow the antenna structures to form a near-field communications loop antenna to handle near-field communications. The antennas antenna structures may include loop antenna structures, inverted-F antenna structures, strip antenna structures, planar inverted-F antenna structures, slot antenna structures, hybrid antenna structures that include antenna structures of more than one type, or other suitable antenna structures. Conductive structures for the antenna structures may, if desired, be formed from conductive electronic device structures.

The conductive electronic device structures may include conductive housing structures. The housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a planar housing wall. The rear housing wall may have slots that pass entirely through the rear housing wall and that therefore separate housing wall portions (and/or sidewall portions) of housing 12 from each other. The rear housing wall may include conductive portions and/or dielectric portions. If desired, the rear housing wall may include a planar metal layer covered by a thin layer or coating of dielectric such as glass, plastic, sapphire, or ceramic. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. Buttons such as button 24 may pass through openings in the cover layer if desired. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalls that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface or wall. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions. Peripheral conductive housing structures 16 and/or the conductive rear wall of housing 12 may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 16 from view of the user).

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of member 16). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 16 and opposing conductive ground structures such as conductive portions of housing 12, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22.

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with peripheral gap structures. For example, peripheral conductive housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two of gaps 18), three peripheral conductive segments (e.g., in an arrangement with three of gaps 18), four peripheral conductive segments (e.g., in an arrangement with four of gaps 18, etc.). The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
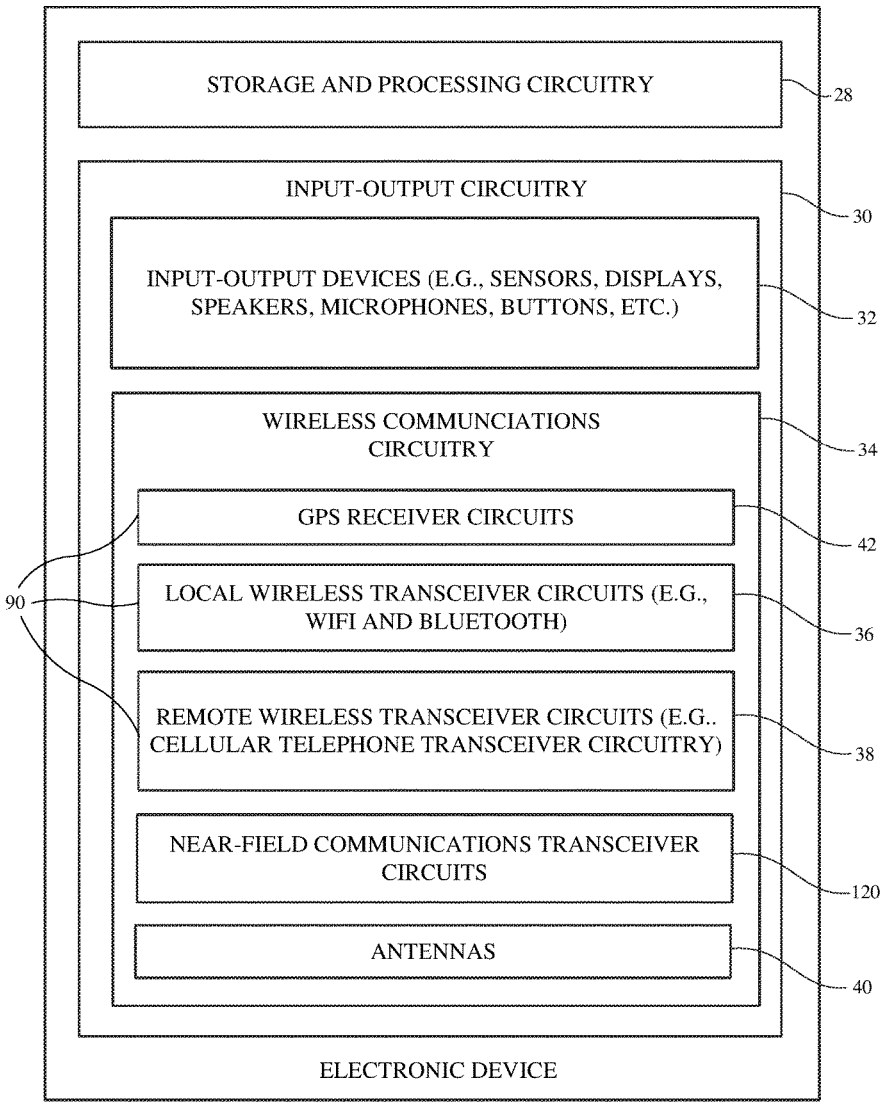
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, near-field communications (NFC) protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors (e.g., a fingerprint sensor integrated with a button such as button 24 of FIG. 1 or a fingerprint sensor that takes the place of button 24), etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a low-midband from 960 to 1710 MHz, a midband from 1710 to 2170 MHz, a high band from 2300 to 2700 MHz, an ultra-high band from 3400 to 3700 MHz or other communications bands between 600 MHz and 4000 MHz or other suitable frequencies (as examples).

Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near-field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless circuitry 34 may include near-field communications circuitry 120. Near-field communications circuitry 120 may produce and receive near-field communications signals to support communications between device 10 and a near-field communications reader or other external near-field communications equipment. Near-field communications may be supported using loop antennas (e.g., to support inductive near-field communications in which a loop antenna in device 10 is electromagnetically near-field coupled to a corresponding loop antenna in a near-field communications reader). Near-field communications links typically are formed over distances of 20 cm or less (i.e., device 10 must be placed in the vicinity of the near-field communications reader for effective communications).

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of these designs, etc. Different types of antennas may be used for different bands and combinations of bands. For example, one type of antenna may be used in forming a local wireless link antenna and another type of antenna may be used in forming a remote wireless link antenna. In addition to supporting cellular telephone communications, wireless local area network communications, and other far-field wireless communications, the structures of antennas 40 may be used in supporting near-field communications. The structures of antennas 40 may also be used in gathering proximity sensor signals (e.g., capacitive proximity sensor signals).

Radio-frequency transceiver circuitry 90 does not handle near-field communications signals and is therefore sometimes referred to as far-field communications circuitry or non-near-field communications circuitry. Near-field communications transceiver circuitry 120 is used in handling near-field communications. With one suitable arrangement, near-field communications can be supported using signals at a frequency of 13.56 MHz. Other near-field communications bands may be supported using the structures of antennas 40 if desired. Transceiver circuitry 90 may handle non-near-field communications frequencies (e.g., frequencies above 600 MHz or other suitable frequencies).

Figure 3:
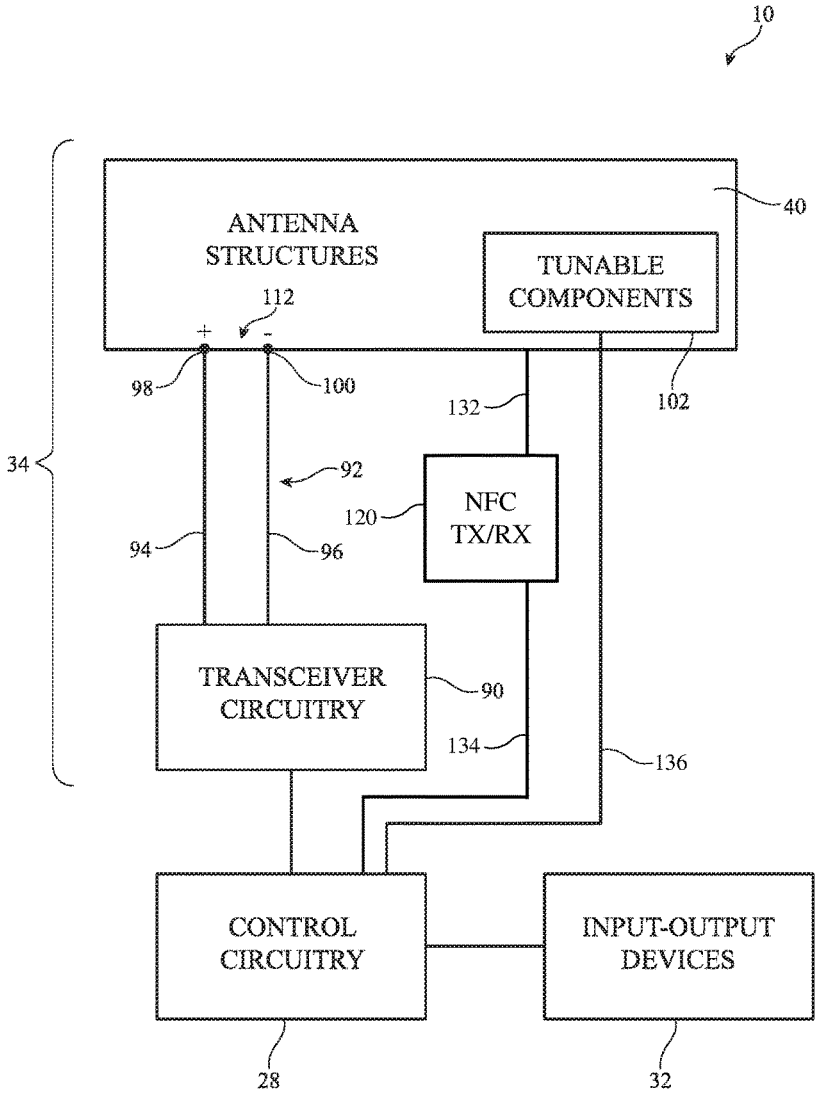
FIG. 3 is a schematic diagram of illustrative wireless communications circuitry in accordance with an embodiment.

As shown in FIG. 3, antenna structures 40 may be coupled to near-field communications circuitry such as near-field communications transceiver 120 and non-near-field communications circuitry such as non-near-field transceiver circuitry 90.

Non-near-field transceiver circuitry 90 in wireless circuitry 34 may be coupled to antenna structures 40 using paths such as path 92. Near-field communications transceiver circuitry 120 may be coupled to antenna structures 40 using paths such as path 132. Paths such as path 134 may be used to allow control circuitry 28 to transmit near-field communications data and to receive near-field communications data using a near-field communications antenna formed from structures 40.

Control circuitry 28 may be coupled to input-output devices 32. Input-output devices 32 may supply output from device 10 and may receive input from sources that are external to device 10.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna (s) 40 may be provided with adjustable circuits such as tunable components 102 to tune antennas over communications bands of interest. Tunable components 102 may be part of a tunable filter or tunable impedance matching network, may be part of an antenna resonating element, may span a gap between an antenna resonating element and antenna ground, etc.

Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 103 that adjust inductance values, capacitance values, or other parameters associated with tunable components 102, thereby tuning antenna structures 40 to cover desired communications bands.

During operation of device 10, control circuitry 28 may issue control signals on one or more paths such as path 136 that adjust inductance values, capacitance values, or other parameters associated with tunable components 102, thereby tuning antenna structures 40 to cover desired communications bands. Active and/or passive components may also be used to allow antenna structures 40 to be shared between non-near-field-communications transceiver circuitry 90 and near-field communications transceiver circuitry 120. Near-field communications and non-near-field communications may also be handled using two or more separate antennas, if desired.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable, a stripline transmission line, or a microstrip transmission line (as examples). A matching network (e.g., an adjustable matching network formed using tunable components 102) may include components such as inductors, resistors, and capacitors used in matching the impedance of antenna(s) 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed 112 with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 100. Other types of antenna feed arrangements may be used if desired. For example, antenna structures 40 may be fed using multiple feeds. The illustrative feeding configuration of FIG. 3 is merely illustrative.

If desired, control circuitry 28 may use an impedance measurement circuit to gather antenna impedance information. Control circuitry 28 may use information from a proximity sensor (see, e.g., sensors 32 of FIG. 2), received signal strength information, device orientation information from an orientation sensor, information about a usage scenario of device 10, information about whether audio is being played through speaker 26, information from one or more antenna impedance sensors, or other information in determining when antenna 40 is being affected by the presence of nearby external objects or is otherwise in need of tuning. In response, control circuitry 28 may adjust an adjustable inductor, adjustable capacitor, switch, or other tunable component 102 to ensure that antenna 40 operates as desired. Adjustments to component 102 may also be made to extend the coverage of antenna 40 (e.g., to cover desired communications bands that extend over a range of frequencies larger than antenna 40 would cover without tuning).

Antennas 40 may include slot antenna structures, inverted-F antenna structures (e.g., planar and non-planar inverted-F antenna structures), loop antenna structures, combinations of these, or other antenna structures.

Figure 4:
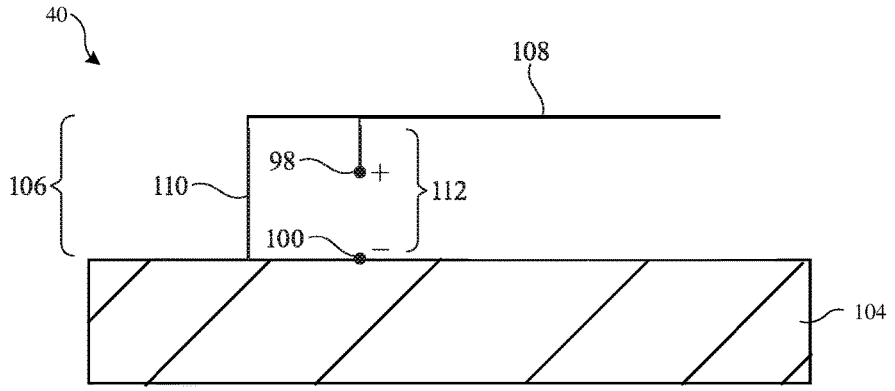
FIG. 4 is a schematic diagram of an illustrative inverted-F antenna in accordance with an embodiment.

An illustrative inverted-F antenna structure is shown in FIG. 4. Inverted-F antenna structure 40 of FIG. 4 has antenna resonating element 106 and antenna ground (ground plane) 104. Antenna resonating element 106 may have a main resonating element arm such as arm 108. The length of arm 108 may be selected so that antenna structure 140 resonates at desired operating frequencies. For example, the length of arm 108 (or a branch of arm 108) may be a quarter of a wavelength at a desired operating frequency for antenna 40. Antenna structure 40 may also exhibit resonances at harmonic frequencies. If desired, slot antenna structures or other antenna structures may be incorporated into an inverted-F antenna such as antenna 40 of FIG. 4 (e.g., to enhance antenna response in one or more communications bands).

Main resonating element arm 108 may be coupled to ground 104 by return path 110. Antenna feed 112 may include positive antenna feed terminal 98 and ground antenna feed terminal 100 and may run parallel to return path 110 between arm 108 and ground 104. If desired, inverted-F antenna structures such as illustrative antenna structure 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.). If desired, antennas such as inverted-F antenna 40 of FIG. 4 may have tunable components such as components 102 of FIG. 3.

Figure 5:
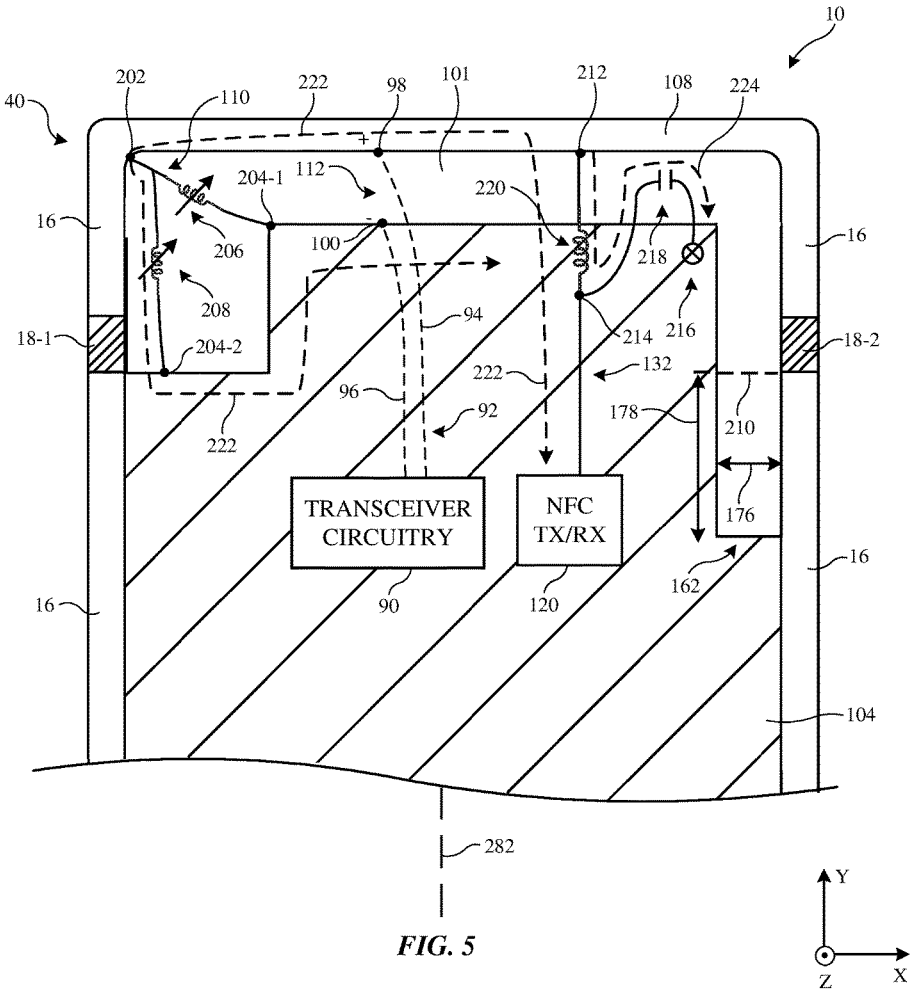
FIG. 5 is a top view of illustrative antenna structures in an electronic device that can be used to handle both non-near-field communications and near-field communications in accordance with an embodiment.

A top interior view of an illustrative portion of device 10 that contains antennas is shown in FIG. 5. As shown in FIG. 5, device 10 may have peripheral conductive housing structures such as peripheral conductive housing structures 16. Peripheral conductive housing structures 16 may be segmented by dielectric-filled gaps (e.g., plastic gaps) 18 such as gaps 18-1 and 18-2. Antenna structures 40 may be used in forming a non-near-field antenna based on an inverted-F antenna design or antenna structures with other designs. Antenna structures 40 may include an inverted-F antenna resonating element arm such as arm 108 that is formed from the segment of peripheral conductive housing structures 16 extending between gaps 18-1 and 18-2.

A dielectric-filled opening such as slot 101 may separate arm 108 from ground 104. Air and/or other dielectric may fill slot 101 between arm 108 and ground structures 104. If desired, slot 101 may be configured to form a slot antenna resonating element structure that contributes to the overall performance of the antenna. Antenna ground 104 may be formed from conductive housing structures, from electrical device components in device 10, from printed circuit board traces, from strips of conductor such as strips of wire and metal foil, or other conductive structures. In one suitable arrangement ground 104 is formed from conductive portions of housing 12 (e.g., portions of a rear wall of housing 12 and portions of peripheral conductive housing structures 16 that are separated from arm 108 by peripheral gaps 18). Return path 110 for inverted-F antenna resonating element arm 108 may be coupled between arm peripheral conductive housing structures 16 and ground 104.

To support near-field communications in device 10, device 10 preferably includes a near-field communications antenna. Space can be conserved by using some or all of antenna structures 40 as both a cellular telephone antenna or other non-near-field communications antenna and as a near-field communications antenna. As an example, a near-field communications antenna for device 10 (e.g., an antenna that is used by near-field communications circuitry 120) may be formed using portions of antenna structures 40 of FIG. 5 such as portions of resonating element 108 and ground 104. By sharing conductive antenna structures between both near-field and non-near-field antennas, duplicative conductive structures can be minimized and antenna volume can be conserved within device 10.

As shown in FIG. 5, a near-field communications antenna for device 10 may be formed from antenna structures 40 such as portions of inverted-F antenna resonating element arm 108, return path 110, and ground 104. The non-near-field communications antenna formed from antenna structures 40 may be fed using an antenna feed such as feed 112. Positive antenna feed terminal 98 of feed 112 may be coupled to peripheral conductive structures 16 whereas ground feed terminal 100 is coupled to ground 104. Positive transmission line conductor 94 and ground transmission line conductor 96 of transmission line 92 may be coupled between transceiver circuitry 90 and antenna feed 112. Transceiver circuitry 90 may handle wireless communications in frequency bands such as a low communications band from 700 to 960 MHz, a low-midband from 960 to 1710 MHz, a midband from 1710 to 2170 MHz, a high band from 2300 to 2700 MHz, an ultra-high band from 3400 to 3700 MHz, 2.4 GHz and 5 GHz bands for WiFi® (IEEE 802.11) communications, and/or a 1575 MHz band for GPS signals.

The non-near-field communications inverted-F antenna formed from structures 40 may have a return path such as return path 110 coupled between arm 108 (at terminal 202) and ground 104 (at terminals 204-1 and 204-2). Return path 110 may include one or more inductors such as inductors 206 and 208. If desired, inductors 206 and 208 may be coupled in parallel between terminal 202 on peripheral conductive housing structure 16 and different locations on ground 104. For example, inductor 206 may be coupled between terminal 202 and ground terminal 204-1, whereas inductor 208 is coupled between terminal 202 and ground terminal 204-2. Inductors 206 and 208 may be fixed inductors or may be adjustable inductors. For example, each inductor may be coupled to a switch that selectively opens to disconnect the inductor between terminal 202 and ground 104.

In this way, return path 110 may be split between a single point 202 on peripheral conductive housing structures 16 and multiple points on ground 104. Because return path 110 is split between two paths that are coupled in parallel between terminal 202 and ground 104, return path 110 may sometimes be referred to herein as a split short path or a split return path. The split short path may, for example, improve antenna efficiency for the non-near-field communications antenna formed from structures 40 relative to scenarios where the return path is implemented using a single conductive path between terminal 202 and ground 104. For example, if return path 110 only included inductor 206, antenna structures 40 may have a relatively high antenna efficiency in a first portion of the midband MB (e.g., between 1710 MHz and 1940 MHz). If return path 110 only included inductor 208, antenna structures 40 may have a relatively high antenna efficiency in a second portion of the midband MB (e.g., between 1940 MHz and 2170 MHz). However, when return path 110 is a split return path that includes both inductor 206 and 208, antenna structures 40 may have a relatively high antenna efficiency across the entire midband MB (e.g., between 1710 MHz and 2170 MHz).

Ground plane 104 may have any desired shape within device 10. For example, ground plane 104 may align with gap 18-1 in peripheral conductive hosing structures 16 (e.g., the lower edge of gap 18-1 may be aligned with the edge of ground plane 104 defining slot 101 adjacent to gap 18-1 such that the lower edge of gap 18-1 is approximately collinear with the edge of ground plane 104 at the interface between ground plane 104 and the portion of peripheral conductive structures 16 adjacent to gap 18-1). This example is merely illustrative and, in another suitable arrangement, ground plane 104 may have an additional vertical slot adjacent to gap 18-1 that extends below gap 18-1 (e.g., along the Y-axis of FIG. 5).

If desired, ground plane 104 may include a vertical slot 162 adjacent to gap 18-2 that extends beyond the lower edge (e.g., lower edge 210) of gap 18-2 (e.g., in the direction of the Y-axis of FIG. 5). Slot 162 may, for example, have two edges that are defined by ground 104 and one edge that is defined by peripheral conductive structures 16. Slot 162 may have an open end defined by an open end of slot 101 at gap 18-2. Slot 162 may have a width 176 that separates ground 104 from the portion of peripheral conductive structures 16 below slot 18-2 (e.g., in the direction of the X-axis of FIG. 5). Because the portion of peripheral conductive structures 16 below gap 18-2 is shorted to ground 104 (and thus forms part of the antenna ground for antenna structures 40), slot 162 may effectively form an open slot having three sides defined by the antenna ground for antenna structures 40. Slot 162 may have any desired width (e.g., about 2 mm, less than 4 mm, less than 3 mm, less than 2 mm, less than 1 mm, more than 0.5 mm, more than 1.5 mm, more than 2.5 mm, 1-3 mm, etc.). Slot 162 may have an elongated length 178 (e.g., perpendicular to width 176). Slot 162 may have any desired length (e.g., 10-15 mm, more than 5 mm, more than 10 mm, more than 15 mm, more than 30 mm, less than 30 mm, less than 20 mm, less than 15 mm, less than 10 mm, between 5 and 20 mm, etc.).

Electronic device 10 may be characterized by longitudinal axis 282. Length 178 may extend parallel to longitudinal axis 282 (and the Y-axis). Portions of slot 162 may contribute slot antenna resonances to antenna 40 in one or more frequency bands if desired. For example, the length and width of slot 162 may be selected so that antenna 40 resonates at desired operating frequencies. If desired, the overall length of slots 101 and 162 may be selected so that antenna 40 resonates at desired operating frequencies.

In order to support near-field communications using antenna structures 40, near-field communications circuitry 120 (NFC TX/RX) may transmit and receive near-field communications signals (e.g., signals in a near-field communications band such as a 13.56 MHz near-field communications band). Near-field communications transceiver circuitry 120 may be coupled to antenna structures 40 using a conductive path such as path 132. Path 132 may, for example, be a single-ended transmission line signal path for conveying single-ended near-field communications signals.

In this scenario, near-field communications transceiver circuitry 120 may include balun circuitry or other circuitry for converting the single-ended signals into differential signals and for converting differential signals into the single-ended signals. As shown in FIG. 5, node 214 on path 132 may be shorted to ground 104 through a capacitive circuit such as capacitor 218. Node 214 may also be coupled to terminal 212 on peripheral conductive housing structures 16 via an inductive circuit such as inductor 220. Inductor 220 may have a selected inductance and capacitor 218 may have a selected capacitance to ensure that antenna structures 40 operate with satisfactory antenna efficiency while conveying both near-field and non-near-field signals.

For example, the inductance of inductor 220 may be selected to ensure that resonating element arm 108 is impedance matched to transmission line 92 at non-near-field communications frequencies (e.g., cellular telephone frequencies). As an example, inductor 220 may have an inductance of approximately 10 nH, between 8 nH and 12 nH, between 5 nH and 15 nH, or other inductances.

In order to perform such impedance matching, inductor 220 is coupled between terminal 212 and ground 104. In scenarios where antenna structures 40 are only used for conveying non-near-field communications, the non-near-field communications antenna formed from structures 40 may exhibit optimal performance at cellular telephone frequencies if inductor 220 is shorted directly to ground plane 104 at node 214. However, when antenna structures 40 are also used to support near-field communications, shorting inductor 220 to ground 104 at node 214 would short out near-field communications signals from transceiver 120 to ground 104 before the corresponding antenna currents could pass to peripheral conductive housing structures 16, thereby preventing structures 40 from wirelessly conveying the near-field signals with satisfactory efficiency.

In order to allow inductor 220 to perform satisfactory impedance matching at non-near-field communications frequencies for the non-near-field communications antenna formed from structures 40 while still allowing structures 40 to support near-field communications, capacitor 218 may short terminal 214 to antenna ground 104 at ground terminal 216 (e.g., inductor 220 may be shorted to ground 104 through node 214 and capacitor 218). Capacitor 218 may have a relatively large capacitance that is selected to block relatively low frequency signals such as near-field communications signals conveyed by transceiver 120 from passing from node 214 to ground point 216 while also allowing relatively high frequency signals such as non-near-field communications signals conveyed by transceiver 90 to pass from node 214 to ground 216. In other words, capacitor 218 may serve as a filter that forms an open circuit between node 214 and terminal 216 at near-field communications frequencies and that forms a short circuit between node 214 and terminal 216 at non-near-field communications frequencies (e.g., frequencies greater than 100 MHz, greater than 20 MHz, greater than 13.56 MHz, etc.). As examples, capacitor 218 may have a capacitance of approximately 50 pF, between 30 and 100 pF, greater than 10 pF, less than 100 pF, greater than 30 pF, greater than 50 pF, or other desired capacitances.

When configured in this way, non-near-field communications antenna signals (antenna currents) such as cellular telephone signals conveyed by feed 112 may follow path 224 from resonating element 108 through inductor 220 and capacitor 218 to ground (through ground terminal 216). At the same time, near-field communication antenna signals (antenna currents) may flow over path 222 through inductor 220, peripheral conductive housing structure 16, return path 110 (e.g., inductor 208), and ground 104 (e.g., a loop path that forms a loop antenna resonating element for a near-field communications loop antenna formed from antenna structures 40). Antenna structures 40 may, if desired, concurrently or simultaneously convey near-field communications signals and non-near-field communications signals with satisfactory efficiency.

In the example of FIG. 5, near-field communications antenna signals are depicted as following path 222 through inductor 208 of return path 110. However, this example is merely illustrative. As previously discussed, return path 110 may be split into two inductors coupled in parallel between terminal 202 and ground 104. Path 222 may therefore pass through inductor 208, inductor 206, or both inductors 206 and 208. Extending the loop antenna resonating element across the width of device 10 in this way may, for example, allow device 10 to be relatively immune to device positioning when communicating with external near-field communications circuitry such as an RFID reader. The example of FIG. 5 is merely illustrative. If desired, inductor 220 and/or capacitor 218 may be replaced with any desired filter circuitry (e.g., filter circuitry including inductive, capacitive, and/or resistive components arranged in any desired manner). The filter circuitry may include, for example, high pass filter circuitry, low pass filter circuitry, band pass filter circuitry, notch filter circuitry, etc.

Figure 6:
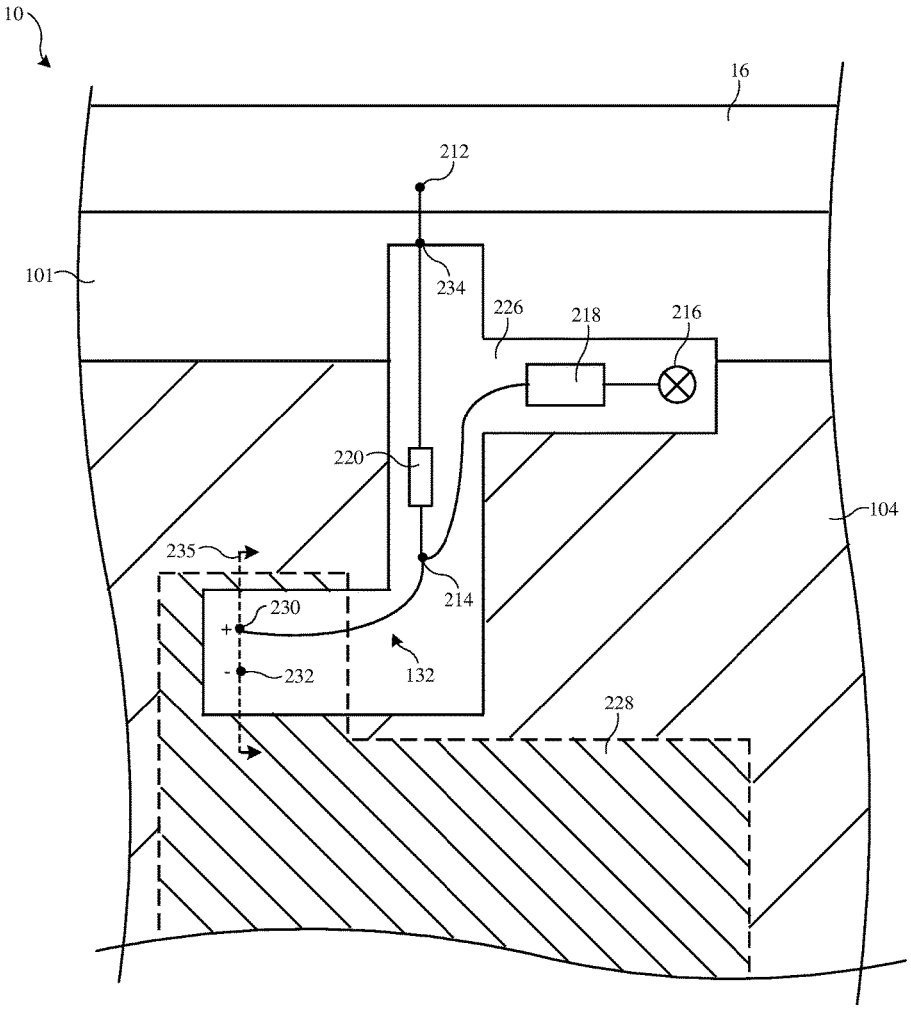
FIG. 6 is a top view of an illustrative flexible printed circuit board that may be used to form a near-field communications feed path in accordance with an embodiment.

FIG. 6 is a top view of path 132 for conveying near-field communications signals using antenna structures 40. As shown in FIG. 6, electronic device 10 may include a flexible printed circuit such as flexible printed circuit board 226. Flexible printed circuit board 226 may be a printed circuit formed from sheets of polyimide or other flexible polymer layers. Flexible printed circuit board 226 may include patterned metal traces for carrying signals between components on the flexible printed circuit board. Inductor 220 and capacitor 218 may be fixed components mounted on flexible printed circuit 226 (e.g., surface mount technology components). In another suitable arrangement, inductor 220 may be formed from a distributed inductance and/or capacitor 218 may be formed from a distributed capacitance on printed circuit 226.

Flexible printed circuit 226 may include a positive antenna feed terminal 230 and a ground antenna feed terminal 232 for the near-field communications antenna. Feed terminals 232 and 230 may, if desired, be coupled to path 132 through a differential-to-single ended converter such as a balun (not shown) that converts differential signals appearing across differential terminals 232 and 230 to single-ended loop current signals that flow over path 132 and loop path 222 of FIG. 5. Path 132 may be formed from metal traces on the printed circuit coupled to transceiver circuitry 120 (e.g., feed terminal 230 or a balun having differential terminals coupled to terminals 230 and 232 and a single ended terminal coupled to path 132). Path 132 may be coupled to node 214. Inductor 220 may be coupled between node 214 and terminal 234 on flexible printed circuit 226. Terminal 234 on the flexible printed circuit may then be coupled to terminal 212 on peripheral conductive housing structure 16. Terminals 212 and 234 may be coupled using any desired conductive structure (e.g., a bracket, clip, spring, pin, screw, solder, weld, conductive adhesive, etc.). If desired, the structure that electrically connects the flexible printed circuit to the peripheral conductive housing structure may also mechanically secure the flexible printed circuit to the peripheral conductive housing structure or another structure within the electronic device.

Capacitor 218 may be coupled between terminal 214 and ground terminal 216. Ground terminal 216 may be formed from any desired conductive structure that is coupled to ground plane 104. In some cases, the structure that electrically connects the terminal 216 to ground may also mechanically secure the flexible printed circuit (e.g., to a conductive support plate that forms at least a portion of ground plane 104). Ground terminal 216 may be formed by a fastener such as a screw or may be formed by any other desired type of conductive structure (e.g., a bracket, clip, spring, pin, screw, solder, weld, conductive adhesive, etc.). If desired, conductive structures may also short ground terminal 216 to grounded conductive structures in display 14 (e.g., a conductive display frame or display plate).

Flexible printed circuit board 226 may be coupled to an additional printed circuit (e.g., printed circuit 228). Printed circuit 228 may be a rigid printed circuit board (e.g., a printed circuit board formed from fiberglass-filled epoxy or other rigid printed circuit board material) or may be a flexible printed circuit (e.g., a flexible printed circuit formed from a sheet of polyimide or other flexible polymer layer). Printed circuit 228 may be the motherboard or main logic board for electronic device 10, for example. Flexible printed circuit board 226 may be connected to printed circuit board 228 at positive antenna feed terminal 230 and/or ground antenna feed terminal 232. Printed circuit board 228 may be mounted above or below flexible printed circuit 226.

Figure 7:
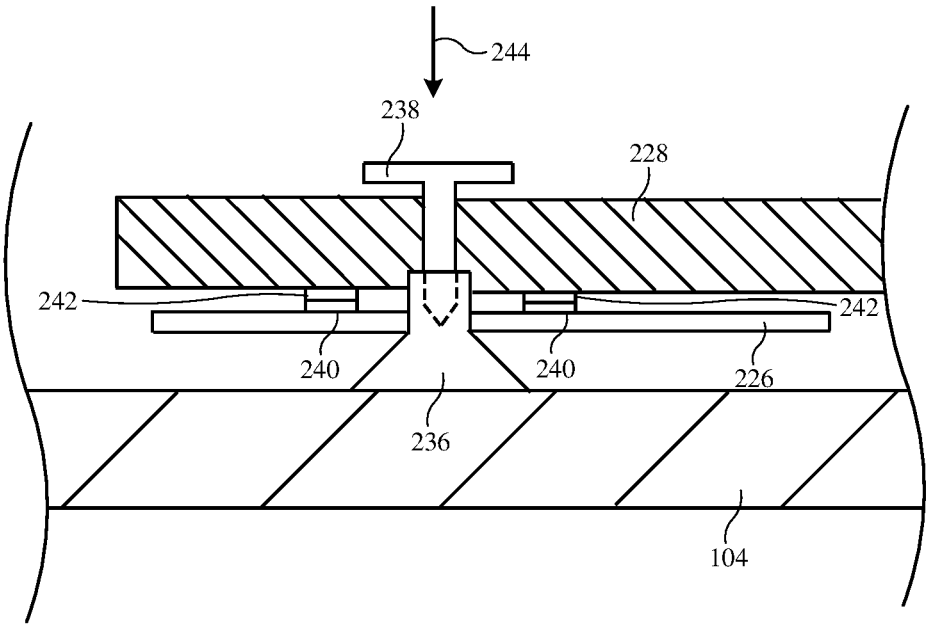
FIG. 7 is a cross-sectional side view of an illustrative flexible printed circuit board that may be used to form a near-field communications feed path in accordance with an embodiment.

FIG. 7 is a cross-sectional side view taken along line 235 in FIG. 6. FIG. 7 shows one example of how ground plane 104, flexible printed circuit 226, and printed circuit board 228 may be connected. As shown in FIG. 7, a conductive screw boss 236 may be formed on ground plane 104. If desired, screw boss 236 may be formed integrally with conductive housing structures (e.g., internal and/or external structures, support plate structures that form a rear housing wall, etc.) that form portions of ground plane 104. Screw boss 236 may be conductive and may short ground plane 104 to flexible printed circuit 226 and printed circuit board 228. In one illustrative embodiment, conductive screw boss 236 may be shorted to a ground antenna feed terminal (i.e., ground antenna feed terminal 232 in FIG. 6) in flexible printed circuit 226. A screw such as screw 238 may be screwed into screw boss 236. Screw 238 may apply a bias force in direction 244 to secure printed circuit board 228 and flexible printed circuit 226 to ground plane 104. Printed circuit board 228 and flexible printed circuit 226 may have openings to receive screw 238, screw boss 236, or a combination of screw 238 and screw boss 236.

The bias force applied by screw 238 may also press feed pads 242 on printed circuit board 228 into feed pads 240 on flexible printed circuit 226. Feed pads 240 and 242 may be conductive feed pads formed on the surface of flexible printed circuit 226 and printed circuit board 228 respectively. Printed circuit board 228 may send antenna feed signals to flexible printed circuit board 226 through feed pads 240 and 242. Feed pads 240 on flexible printed circuit 226 may be considered to form the positive antenna feed terminal (e.g., positive antenna feed terminal 230 in FIG. 6 or the single ended output of a balun coupled to the differential feed terminals of transceiver 120) for the near-field communications antenna. Feed pads 240 and 242 may have an annular shape such that the feed pads surround screw boss 236. Alternatively, feed pads 240 and 242 may have any other desired shape.

The example of FIG. 7 where flexible printed circuit 226 is formed underneath printed circuit board 228 is merely illustrative. If desired, printed circuit board 228 may be formed underneath flexible printed circuit 226. Additionally, in the example of FIG. 7, screw 238 is not used to electrically connect any components within the electronic device. Therefore, screw 238 does not need to be conductive (i.e., screw 238 could be a dielectric material such as plastic). However, in other embodiments, screw 238 may be formed from a conductive material and may electrically connect components together. For example, screw 238 may electrically connect printed circuit board 228, flexible printed circuit 226, and/or ground plane 104. In embodiments where screw 238 electrically connects components, some or all of screw boss 236 may be formed from a dielectric material if desired.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

antenna structures having an antenna resonating element arm and an antenna ground;

non-near-field communications transceiver circuitry coupled to the antenna resonating element arm and configured to convey non-near-field communications signals using the antenna structures;

near-field communications transceiver circuitry coupled to the antenna resonating element arm through a conductive path, wherein the near-field communications transceiver circuitry is configured to convey near-field communications signals using the antenna structures and the conductive path; and a capacitor coupled between the conductive path and the antenna ground, wherein the capacitor is configured to short the non-near-field communications signals to the antenna ground and to block the near-field communications signals from passing from the conductive path to the antenna ground.

2. The electronic device defined in claim 1, further comprising an inductor interposed in the conductive path between the near-field communications transceiver circuitry and the antenna resonating element arm.

3. The electronic device defined in claim 2, wherein the inductor is coupled between a node on the conductive path and the antenna resonating element arm and the capacitor is coupled between the node and the antenna ground.

4. The electronic device defined in claim 3, wherein the capacitor has a capacitance between 30 pF and 100 pF.

5. The electronic device defined in claim 3, wherein the capacitor and inductor are mounted on a flexible printed circuit board.

6. The electronic device defined in claim 5, wherein the capacitor is coupled between the node on the conductive path and a fastener that electrically couples the capacitor to the antenna ground and mechanically attaches the flexible printed circuit to the antenna ground.

7. The electronic device defined in claim 6, wherein the conductive path is coupled to a feed pad on a rigid printed circuit board.

8. The electronic device defined in claim 7, further comprising an additional fastener that attaches the flexible printed circuit board to the rigid printed circuit board.

9. The electronic device defined in claim 8, further comprising a balun on the rigid printed circuit board that is coupled to the feed pad.

10. The electronic device defined in claim 1, further comprising:

a housing having peripheral conductive housing structures, wherein the antenna resonating element arm is formed from a segment of the peripheral conductive housing structures.

11. An electronic device comprising:

an antenna ground;

an antenna resonating element arm that is configured to convey non-near-field communications signals in a first frequency band;

a return path coupled between the antenna resonating element arm and the antenna ground;

a conductive path coupled to the antenna resonating element arm, wherein the conductive path, at least a portion of the antenna resonating element arm, at least a portion of the return path, and at least a portion of the antenna ground form a conductive loop path that is configured to convey near-field communications signals in a second frequency band; and an electronic component that is coupled between the conductive path and the antenna ground, wherein the electronic component is configured to form a short circuit between the conductive path and the antenna ground in the first frequency band and to form an open circuit in the second frequency band.

12. The electronic device defined in claim 11, further comprising:

near-field communications transceiver circuitry coupled to the conductive path.

13. The electronic device defined in claim 12, wherein the conductive path comprises a node coupled between the near-field communications transceiver circuitry and the antenna resonating element arm and the electronic component is coupled between the node and the antenna ground, the electronic device further comprising:

an additional electronic component coupled between the node and the antenna resonating element arm.

14. The electronic device defined in claim 13, wherein the electronic component comprises a capacitor.

15. The electronic device defined in claim 13, wherein the additional electronic component comprises an inductor.

16. The electronic device defined in claim 15, wherein the electronic component comprises a capacitor.

17. An electronic device comprising:

an inverted-F antenna resonating element arm;

an antenna ground;

non-near-field communications transceiver circuitry that conveys non-near-field communications signals using the inverted-F antenna resonating element arm;

a split return path coupled between the inverted-F antenna resonating element arm and the antenna ground; and near-field communications transceiver circuitry that is coupled to the inverted-F antenna resonating element arm and that conveys near-field communications signals using the inverted-F antenna resonating element arm, at least some of the split return path, and at least some of the antenna ground.

18. The electronic device defined in claim 17, wherein the split return path includes a first conductive path coupled between a first terminal on the inverted-F antenna resonating element arm and a second terminal on the antenna ground and a second conductive path coupled between the first terminal and a third terminal on the antenna ground that is different than the second terminal.

19. The electronic device defined in claim 18, wherein the first conductive path of the split return path includes a first inductor and the second conductive path of the split return path includes a second inductor.

20. The electronic device defined in claim 19, wherein the first and second inductors are adjustable.

* * * * *